United States Patent [19]

Itoh

[11] 4,140,886

[45] Feb. 20, 1979

[54] MAGNETIC TYPE PICKUP CARTRIDGE BLOCK SHAPED POLE PIECE CONSTRUCTION

[75] Inventor: Masashi Itoh, Settsu, Japan

[73] Assignee: Matsushita Electric Industrial Co., Ltd., Osaka, Japan

[21] Appl. No.: 640,470

[22] Filed: Dec. 15, 1975

[30] Foreign Application Priority Data

Jan. 31, 1975 [JP] Japan ..... 50-13902

[51] Int. Cl.[2] ..... H04R 11/12

[52] U.S. Cl. ..... 179/100.41 K; 179/100.41 M; 274/37

[58] Field of Search ..... 179/100.41 K, 100.41 M, 179/100.41 Z

[56] References Cited

U.S. PATENT DOCUMENTS

| | | | |
|---|---|---|---|
| 3,067,295 | 12/1962 | Stanton | 179/100.41 K |
| 3,383,474 | 5/1968 | Kriebel et al. | 179/100.41 K |
| 3,546,399 | 12/1970 | Stanton | 179/100.41 K |
| 3,881,073 | 4/1975 | Grado | 179/100.41 K |

*Primary Examiner*—Raymond F. Cardillo, Jr.
*Attorney, Agent, or Firm*—Burgess, Ryan and Wayne

[57] ABSTRACT

A magnetic type stereophonic pickup cartridge wherein four block-shaped pole pieces which are simple in construction and design and made of ferrite are assembled into a pole piece assembly. The eddy-current loss may be minimized, and the magnetic circuits of the right and left channels may be made completely symmetrical with the same length of the magnetic path, whereby the high sensitivity and flat frequency response characteristic may be ensured over the whole audible range.

5 Claims, 10 Drawing Figures

MAGNETIC TYPE PICKUP CARTRIDGE BLOCK SHAPED POLE PIECE CONSTRUCTION

BACKGROUND OF THE INVENTION

The present invention relates to a magnetic type pickup cartridge, and more particularly a moving-magnet type stereophonic pickup cartridge which is extremely simple in construction and may exhibit considerably improved desired characteristics such as frequency response.

In general, a moving-magnet type pickup cartridge consists of a moving unit consisting of a stylus bar with a stylus attached to one end thereof and with a moving magnet attached to the other end thereof and supported in a sleeve made of a non-magnetic material through a damper made of an elastic material, and a voltage generating or inducing unit consisting of a yoke made of a high-permeability material and coupled to the moving unit in such a way that the variation in magnetic flux flowing through the yoke may be induced by the movement of the moving unit and consequently a voltage may be induced across a coil mounted on the yoke. The quality of the pickup cartridges is, in general, dependent upon how faithfully the variation in magnetic flux caused in the moving unit is transmitted to the voltage generating unit. Therefore, the loss in the magnetic circuit must be minimized, and the frequency response characteristic must be as flat as possible over the audible range. In the conventional pickup cartridge, a balanced winding of two coils for each channel is employed in order to cancel externally induced hum, so that four coils are employed in the stereophonic pickup cartridge. In addition the complete separation between the right and left channels must be ensured, and the magnetic circuits for the right and left channels must be symmetrical with the same length of the magnetic path.

Even in the conventional moving-magnet type stereophonic pickup cartridges designed to satisfy the above and other requirements as much as possible, the length of the magnetic circuit or path is different between the right and left channels, as will be described in detail hereinafter, so that the balanced magnetic characteristics cannot be attained. In addition, the pole pieces and yokes each fabricated by drawing of a permalloy sheet are used, because ferrite is not adapted to be drawn, so that various magnetic losses occur. As a result, the flat frequency response characteristic cannot be attained, and the response at high frequencies is considerably attenuated. The reason is mainly attributed to the eddy-current loss caused by the skin effect due to the dimensions and configurations of the pole pieces and yokes made of permalloy. In order to overcome these drawbacks it has been proposed to use laminated pole pieces and yokes, but the sensitivity drops. Furthermore, the fabrication of the laminated pole pieces and yokes is very complex because the thin sheets formed by the drawing must be subjected to heat-treatment in order to improve the magnetic properties and because the thin sheets must be laminated without being subjected to any mechanical distortions.

SUMMARY OF THE INVENTION:

One of the objects of the present invention is therefore to provide a magnetic type pickup cartridge which minimizes the eddy-current losses in the pole pieces and yokes and in which the magnetic circuits for both the channels are completely symmetrical.

Another object of the present invention is to provide a magnetic type pickup cartridge which may ensure the high sensitivity and flat frequency response characteristic over the whole audio range.

A further object of the present invention is to provide a magnetic type pickup cartridge which is simple in construction and easy to manufacture and assemble.

A further object of the present invention is to provide a magnetic type pickup cartridge in which components are machined or otherwise formed with very close dimensional tolerances and assembled with a high degree of accuracy, whereby the frequency response, phase and channel separation characteristics as well as transmission characteristic may be considerably improved over the prior art cartridges.

To the above and other ends, the present invention provides a magnetic type pickup cartridge characterized in that the lower end portion of each of four block-shaped pole pieces made of a high-permeability material terminates into an inclined surface inclined at 45° to the horizontal; said four pole pieces are assembled in such a way that said inclined surfaces may define a space having a substantially square cross sectional configuration; the free ends of an inverted U-shaped yoke made of a high-permeability material are attached to the upper surfaces of the pole pieces with the inclined surface in opposed relation when assembled; and a moving magnet mounted at the one end of a stylus bar is placed in said space defined by said inclined surfaces of said pole pieces.

BRIEF DESCRIPTION OF THE DRAWING:

Same reference numerals are used to designate similar parts throughout FIG. 4 to FIG. 10.

Figure 1:
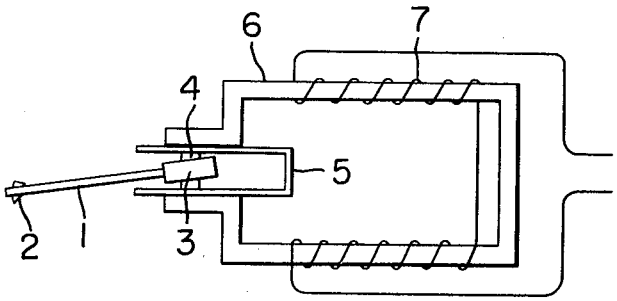
FIG. 1 is a schematic side view of a moving-magnet type pickup cartridge used for the explanation of the underlying principle thereof.
Figure 2:
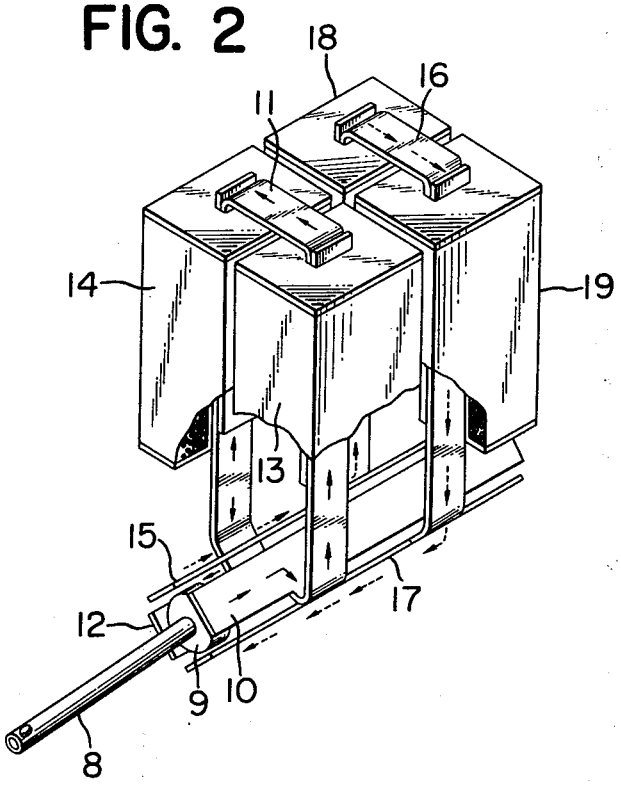
FIG. 2 is a perspective view of one example of the prior art moving-magnet type stereophonic pickup cartridge.
Figure 3:
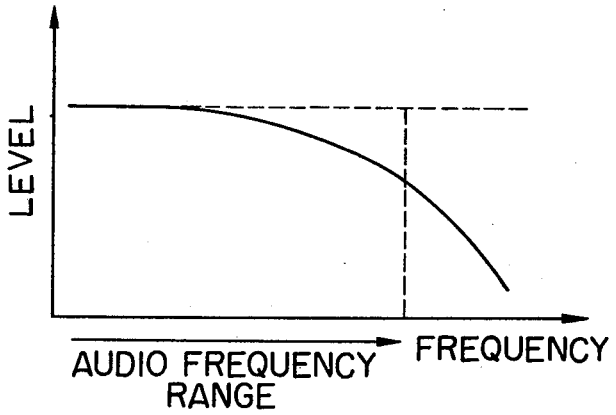
FIG. 3 is a graph of the frequency response characteristic thereof.

DESCRIPTION OF THE PREFERRED EMBODIMENTS:

Prior Art, FIGS. 1 through 3

FIG. 1 is a schematic view of a basic moving-magnet type pickup cartridge used for the explanation of the underlying principle thereof. A stylus bar 1 with a stylus 2 attached to one end thereof and with a moving magnet 3 mounted at the other end thereof is mounted by a damper 4 made of an elastic material within a sleeve 5 made of a non-magnetic material and interposed between the free ends of a yoke 6 made of a material having a high permeability. In response to the movement of the stylus bar 1, the moving magnet 3 is actuated so that the magnetic flux in the yoke 6 changes and consequently a voltage is induced in a coil 7 mounted on the yoke 6.

In general, the quality of the pickup cartridges is dependent upon how faithfully the magnetic flux variation caused in the moving unit consisting of the stylus bar 1, the damper 4 and the sleeve 5 is transmitted to the voltage inducing unit consisting of the yoke 6 and the coil 7 mounted thereupon. It is essential that the loss in the magnetic circuit is minimum and that the frequency response characteristic curve must be flat over a wide frequency. In the conventional magnetic type stereophonic pickup cartridges, the balanced winding of two parallel coils is employed in order to cancel the externally induced hum so that each stereophonic pickup cartridge includes four coils. In addition, the right and left channels must be completely separated from each other, and the lengths of their magnetic paths must be exactly equal to each other.

FIG. 2 is a schematic perspective view of one example of the prior art magnetic type pickup cartridges constructed and designed for satisfying the above requirements. The variation in magnetic flux caused by the moving unit consisting of the stylus bar 8 and the moving magnet 9 mounted at the rear end thereof is transmitted to the pole piece assembly consisting of pole pieces each formed by drawing a high-permeability blank such as permalloy. The variation in magnetic flux in the left channel flowing through a pole piece 10, a yoke 11, a pole piece 12 back to the moving magnet 9 induces a voltage in coils 13 and 14 mounted on the yoke 11 while the variation in magnetic flux in the right channel flowing from the moving magnet 9 through a pole piece 15, a yoke 16, a pole piece 17 back to the moving magnet 9 induces a voltage in coils 18 and 19 mounted on the yoke 16.

Since the yoke 16 is positioned backwardly of the yoke 11 with respect to the moving magnet 9, the length of the right-channel pole pieces 15 and 17 is longer than the length of the left-channel pole pieces 10 and 12. As a result, the right- and left-channel magnetic circuits do not have the same length so that the magnetic characteristics are different between the right and left channels.

In addition, the pole pieces 9, 12, 15 and 17 and the yokes 11 and 16 are generally fabricated by drawing. Therefore, the blanks with poor drawability such as ferrite cannot be used. Therefore, they are, in general, made of permalloy with the result of various magnetic losses. As a result, as shown in FIG. 3, the flat frequency response characteristic curve cannot be attained over the desired range. That is, the remarkable attenuation in high frequencies is observed. The main reason is that the eddy-current loss is induced by the skin effect caused by the dimensions and shapes of the pole pieces and yokes, which are made of permalloy. In order to overcome this problem, there has been proposed to use the laminated pole pieces and yokes, but the use of these laminated pole pieces and yokes results in the decrease in sensitivity. In addition, the fabrication of such laminated pole pieces and yokes as shown in FIG. 2 is very complex because, after drawing, the drawn sheets must be subjected to the heat-treatment step in order to improve the magnetic properties and then they must be laminated without causing any mechanical distortions.

The Invention

Figure 4:
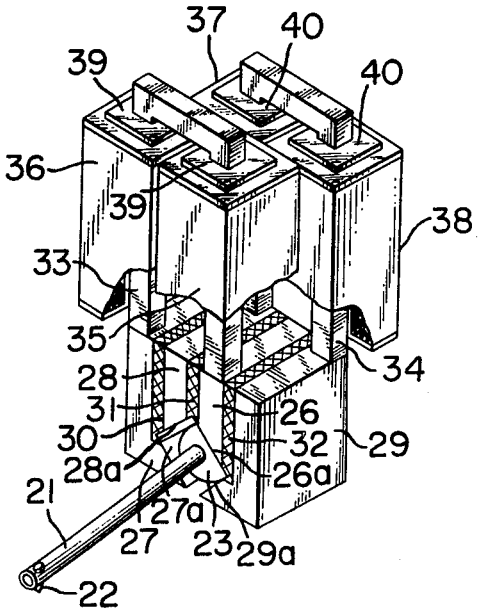
FIG. 4 is a perspective view of a first embodiment of the present invention.
Figure 5:
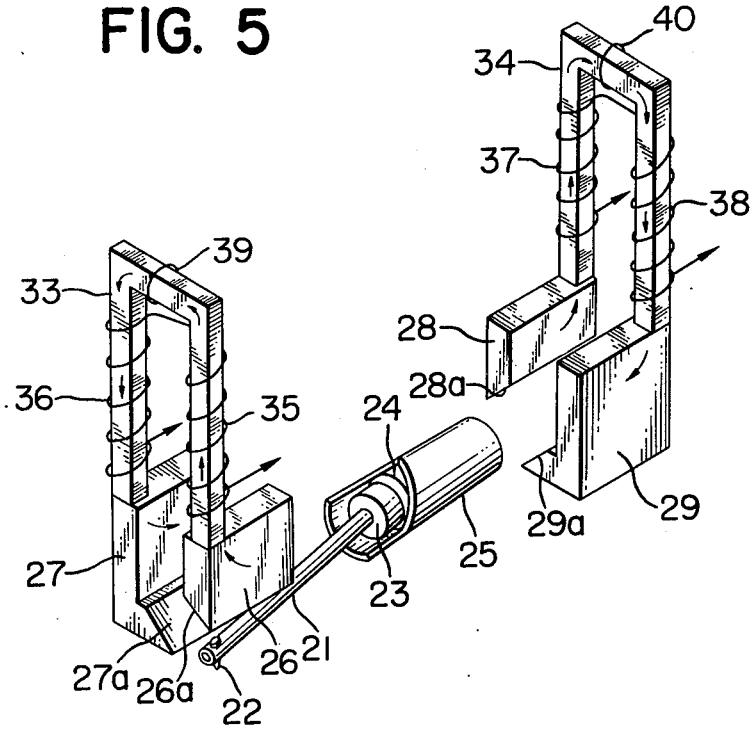
FIG. 5 is an exploded perspective view thereof.
Figure 6:
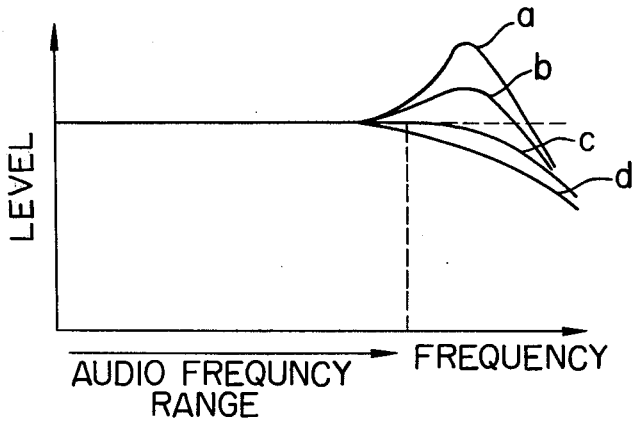
FIG. 6 is a graph used for the explanation of the frequency response characteristic thereof.

First Embodiment, FIGS. 4, 5 and 6

In FIGS. 4 and 5, there is shown the first embodiment of a magnetic type pickup cartridge in accordance with the present invention which includes a stylus bar 21 with a stylus 22 attached to one end thereof and with a moving magnet 23 as an armature attached to the other end thereof, a damper 24 made of an elastic material and supporting the moving magnet 23, and a sleeve 25 for supporting the stylus bar 21 through the damper 24. The parts 21 through 25 constitute a moving unit. The detailed description of the mentioned moving unit can be found, for example, in U.S. Pat. No. 3576955. The pickup cartridge further includes a voltage generating unit consisting of a pole piece block, and yokes 33 and 34 with coils 35, 36, 37 and 38. The pole piece block consists of four block-shaped pole pieces 26, 27, 28 and 29 made of ferrite and having inclined surfaces **26*a*, 27*a*, 28*a* and 29*a* so inclined at 45° to the horizontal, dimensioned and shaped that the inclined surfaces 26*a* and 27*a* of the pole pieces 26 and 27 may be located in opposed relationship and spaced apart by a predetermined distance from each other while the inclined surfaces 28*a* and 29*a* of the pole pieces 28 and 29 may be located in opposed relationship and spaced apart by a predetermined distance from each other as best shown in FIG. 5 when the pole pieces 26 through 29 are assembled. When the pole pieces 26 through 29 are assembled, spacers 30, 31 and 32 made of non-magnetic material are interposed between the pole pieces 27 and 28, between the pole pieces 28 and 26 and between the pole pieces 26 and 29, respectively, as shown in FIG. 4. Thus, the pole piece assembly is provided, and the space having a substantially square or diamond cross sectional configuration is defined by the four inclined surfaces 26*a* through 29*a* of the pole pieces 26 through 29**.

The inverted U-shaped yokes 33 and 34 made of ferrite and having coils 35, 36, 37 and 38 mounted thereupon are mounted on the pole piece assembly and magnetically coupled thereto, and short rings 39 and 40 made of an electrically conductive material are inserted into the magnetic circuits.

The sleeve 25 of the moving unit is placed in the space defined by the inclined surfaces **26*a* through 29*a* in such a way the moving magnet 23 may be located substantially at the midpoint of the space in the axial direction thereof. Therefore, as indicated by the arrows in FIG. 5, the magnetic circuit of the left channel consists of the pole piece 26, the yoke 33, the pole piece 27 and the moving magnet 23 while the magnetic circuit of the right channel consists of the pole piece 28, the yoke 34, the pole piece 29 and the moving magnet 23**. The magnetic circuits of the left and right channels are completely symmetrical so that the output voltage, the frequency response and the phase characteristic may be completely balanced between the right and left channels.

In the first embodiment, the pole pieces 26 through 29 and the yokes 33 and 34 are so designed that no drawing step may be required for the fabrication of these components. That is, they may be advantageously made of ferrite which is so ductile that they cannot be subjected to the drawing. As a result, the eddy-current loss may be minimized, and as shown in FIG. 6 the flat frequency response characteristic curve is obtained not only over the audible range but also the range beyond the audible range. However, as indicated by the curve a in FIG. 6 the resonance occurs due to the magnetic properties of ferrite and the electrical load on an amplifier for a pickup cartridge, but this resonance problem may be overcome by suitably designing the configurations of the pole pieces and yokes and by selecting the suitable number of turns of the coils. Furthermore, the resonance within the audible range and the attenuation in the high frequency range may be solved as shown by the curves a, b, c and d in FIG. 6 by suitably selecting the resistance, material, shapes and number of the short rings 39 and 40 inserted in the magnetic circuits. Since the insertion of the short rings 39 and 40 causes the local eddy-current loss, the eddy-current loss may be suitably used to adjust the frequency range. For instance when no short ring is inserted, the characteristic curve a is obtained. When the characteristic curve c which is substantially flat even in the range beyond the audible range is attained, the frequency, phase and distortion characteristics of the pickup cartridge may be remarkably improved.

In the prior art type pickup cartridge of the type shown in FIG. 2, the pole pieces and yokes are made into contact with each other within the coils so that the coupling degree therebetween varies from one cartridge to another. However, according to the first embodiment of the present invention, the pole pieces 26 through 29 and yokes 33 and 34 are coupled to each other outside of the coils 35 through 38 so that there is no variation in coupling degree from one cartridge to another. Moreover, the cross sectional areas of both the pole pieces and yokes within the coils may be minimized with the result of low inductance and low impedance. Therefore, the flat frequency characteristic curve extending over the audible range may be obtained in a simple manner without the sacrifice of the output voltage.

The pole pieces 26 through 29 and yokes 33 and 34 of the first embodiment are very simple in construction so that the mass production thereof by machining at low cost may become possible. In the prior art cartridge of the type shown in FIG. 2, the correct positioning of the pole pieces 10, 12, 15 and 17 is difficult so that the channel separation is not satisfactory, but in accordance with the present invention, the pole pieces 26 through 29 may be machined with closer dimmensional tolerances and may be correctly positioned and assembled with respect to each other so that the channel separation characteristic may be considerably improved.

Figure 7:
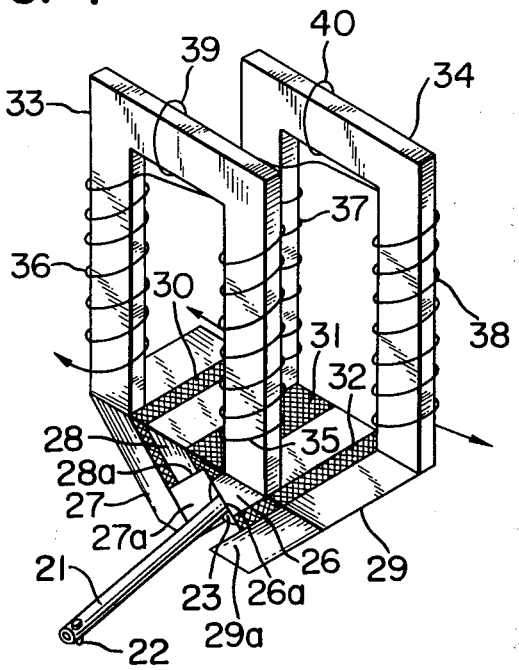
FIGS. 7, 8 9 and 10 are schematic perspective views of some modifications of the first embodiment, respectively.

Modification, FIG. 7

The configurations of the pole pieces 26 through 29 may be modified as shown in FIG. 7. In this embodiment, since the pole pieces are more in the shape of flat plates and the area enclosed by the pole pieces 26 through 29 and the spacers 30 through 32 is cut in oblique at its top surface, the block can be assembled easily and the top surface, where the yokes are attached, of each pole piece is larger in area than the respective cross section of pole piece.

Figure 8:
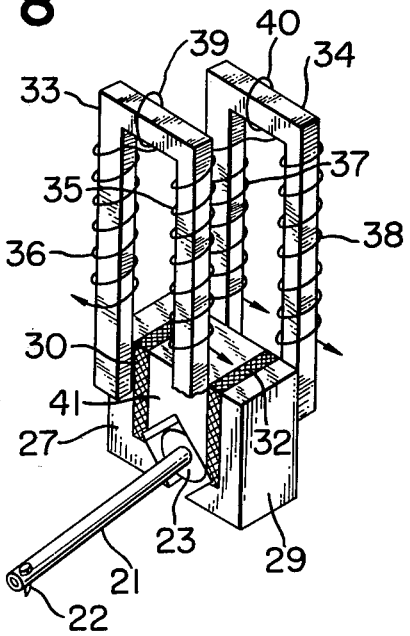

Modification, FIG. 8

In the modification shown in FIG. 8, instead of the pole pieces 26 and 28, an integral pole piece 41 with inverted V-shaped inclined surfaces may be used. In this modification, therefore, the complete theoretical channel separation cannot be attained, but in practice the magnetic circuits may attain a satisfactory channel separation.

Figure 9:
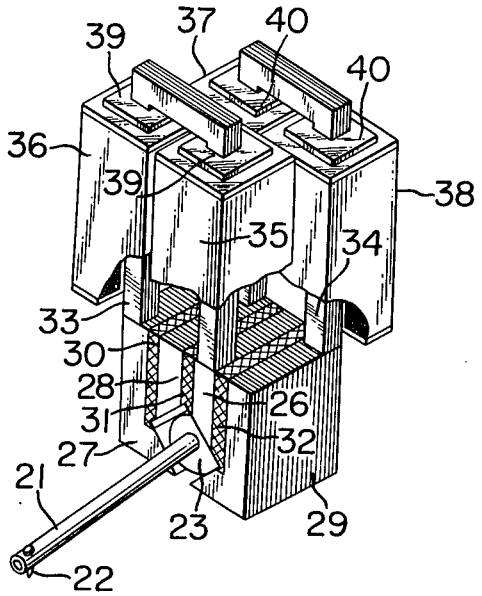
Figure 10:
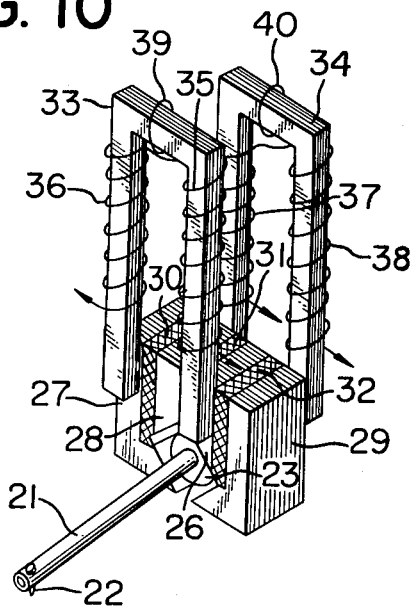

Modifications, FIGS. 9 and 10

So far the pole pieces 26 through 29 and yokes 33 and 34 have been described as being made of ferrite, but the laminated pole pieces and yokes consisting of thin permalloy sheets punched or otherwise by a conventional manner may be used. Since the pole pieces and yokes may be assembled by the lamination of thin permalloy sheets which have not been subjected to the drawing step, they are less subjected to the mechanical distortions after the heat-treatment, and the assembly may be also much facilitated. The laminated pole pieces and yokes may be assembled in the same manner with that described above with a higher degree of accuracy so that the frequency response characteristic, the channel separation characteristics and other characteristics may be considerably improved over the prior art cartridges. While we have shown and described particular embodiment such as moving type magnet pickup cartridge, it will be obvious to those skilled in the art that other type of cartridge such as, for example, induced magnet type or moving iron type cartridge may be modified within the sprit of the invention and the scope of the accompanying claims.

What is claimed is:

1. A magnetic type pickup cartridge, comprising:

a pivotally supported stylus bar;

an elongated armature fixed to the stylus bar;

a first U-shaped yoke of high permeability magnetic material having adjacent leg ends;

a second U-shaped yoke of high permeability magnetic material having adjacent leg ends;

first, second, third and fourth pole pieces arranged adjacent each other in the order mentioned to define an elongated space surrounded by said pole pieces, said space having a square cross-section, said armature being disposed in said space with the longitudinal axis of the armature aligned with the longitudinal axis of said space, said first and third pole pieces being contiguous with respective leg ends of said first yoke, said second and fourth pole pieces being contiguous with respective leg ends of said second yoke, said first pole piece having one upstanding leg and another leg forming a base portion transverse thereto, said one leg of said first pole piece being aligned with the contiguous leg of the first yoke, the other leg of said first pole piece having an associated base plane parallel to the longitudinal axes of said armature and said space of square cross-section, said other leg terminating in a plane surface parallel to said longtiundinal axes adjacent said elongated space, facing the end of said third pole piece adjacent said elongated space, and oriented at a 45° angle with respect to said base plane of said other leg of said first pole piece, said fourth pole piece having one upstanding leg and another leg forming a base portion transverse thereto, said first and fourth pole pieces being oriented as mirror images of each other with respect to a plane passing through said longitudinal axes and parallel to said one leg of said first pole piece, said one leg of said fourth pole piece being parallel to said one leg of said first pole piece, said other leg of said fourth pole piece having an associated base plane coextensive with the base plane of the corresponding leg of said first pole piece and terminating in a plane surface parallel to said longitudinal axes, adjacent said elongated space, facing the end of said second pole piece adjacent said elongated space, and oriented at a 45° angle with respect to said base plane of said other leg of said fourth pole piece, said first, second, third and fourth pole pieces having aligned side surfaces defining the boundary surfaces of said elongated space, the combination of said first yoke with said first and third pole pieces having the same shape as the combination of said second yoke with said second and fourth pole pieces, said first and third pole pieces being intermeshed with said second and fourth pole pieces to define said elongated space as aforesaid.

2. A magnetic type pickup cartridge according to claim 1, wherein spacers of non-magnetic material are disposed between adjacent pole pieces.

3. A magnetic type pickup cartridge according to claim 1, wherein the two yokes are juxtaposed in the axial direction of the stylus bar, and said armature is located exactly at the midpoint of said elongated space in the longitudinal direction thereof.

4. A magnetic type pickup cartridge according to claim 1, further comprising first and second coils wound on the legs of said first and second yokes respectively, wherein the free ends of the U-shaped yokes extend out of the coils and are disposed outside of said coils at said pole pieces.

5. A magnetic type pickup cartridge according to claim 1, further comprising an additional short-circuited coil wound on each of said yokes for linearizing the frequency response of said cartridge.

* * * * *

UNITED STATES PATENT OFFICE
CERTIFICATE OF CORRECTION

Patent No. 4,140,886 Dated February 20, 1979

Inventor(s) Masashi Itoh

It is certified that error appears in the above-identified patent and that said Letters Patent are hereby corrected as shown below:

Figs. 1, 2 & 3 should be labeled "PRIOR ART".

Fig. 6: "AUDIO FREQUNCY" should be --AUDIO FREQUENCY--.

Column 2, lines 3-4: "characteristic" should be --characteristics--.

line 46: "7, 8 9 and 10" should be --7, 8, 9 and 10--.

Column 5, line 40: "dimmensional" should be --dimensional--.

Column 6, line 47: "longtiudinal" should be --longitudinal--.

Signed and Sealed this

*Twenty-fifth* Day of *September 1979*

[SEAL]

*Attest:*

*Attesting Officer*

LUTRELLE F. PARKER

*Acting Commissioner of Patents and Trademarks*